US006361628B1

(12) United States Patent
Van Den Brande et al.

(10) Patent No.: US 6,361,628 B1
(45) Date of Patent: Mar. 26, 2002

(54) METHOD FOR MAKING A COMPOSITE METAL PRODUCT

(75) Inventors: Pierre Van Den Brande, Brussels; Alain Weymeersch, Wavre; Fabrizio Maseri, Bolinne; Philippe Harlet, Charleroi; Lucien Renard, Seraing, all of (BE)

(73) Assignee: Recherche et Developpment du Groupe Cockerill Sambre, Liege (BE)

( * ) Notice: Subject to any disclaimer, the term of this patent is extended or adjusted under 35 U.S.C. 154(b) by 0 days.

(21) Appl. No.: 09/529,604

(22) PCT Filed: Oct. 16, 1998

(86) PCT No.: PCT/BE98/00154

§ 371 Date: Apr. 17, 2000

§ 102(e) Date: Apr. 17, 2000

(87) PCT Pub. No.: WO99/20808

PCT Pub. Date: Apr. 29, 1999

(30) Foreign Application Priority Data

Oct. 17, 1997 (EP) ..... 97203241

(51) Int. Cl.[7] ..... C23C 8/00; C23C 14/22
(52) U.S. Cl. ..... 148/525; 148/565
(58) Field of Search ..... 148/512, 525, 148/565

(56) References Cited

U.S. PATENT DOCUMENTS

| | | | | | |
|---|---|---|---|---|---|
| 3,804,679 | A | * | 4/1974 | Streel | 148/525 |
| 4,872,926 | A | * | 10/1989 | Giacobbe | 148/565 |
| 5,232,789 | A | * | 8/1993 | Platz et al. | 148/537 |
| 5,354,963 | A | * | 10/1994 | Muller et al. | 148/565 |
| 6,099,667 | A | * | 8/2000 | Vanden Brande et al. | 148/565 |

FOREIGN PATENT DOCUMENTS

| | | | | |
|---|---|---|---|---|
| EP | 0 340 077 | | 2/1989 | |
| EP | 0 640 692 | | 1/1995 | |
| FR | 2008969 | | 1/1970 | |
| JP | 3-177560 | * | 8/1991 | 427/527 |

OTHER PUBLICATIONS

Patent Abstracts of Japan, vol. 006, No. 057, Apr. 14, 1982, JP 56 169768 A.

* cited by examiner

*Primary Examiner*—George Wyszomierski
(74) *Attorney, Agent, or Firm*—Browdy and Neimark

(57) ABSTRACT

The invention concerns a method for making a composite metal product by adding at least one substance to said product, which consists in using a metal product in the form of a continuous strip (1) moved in a vacuum chamber (2), applying the substance on said strip and diffusing said substance at least partially into the strip when it is passing in the vacuum chamber maintaining it at a temperature lower than its melting point, but sufficiently high for enabling said diffusion.

11 Claims, 1 Drawing Sheet

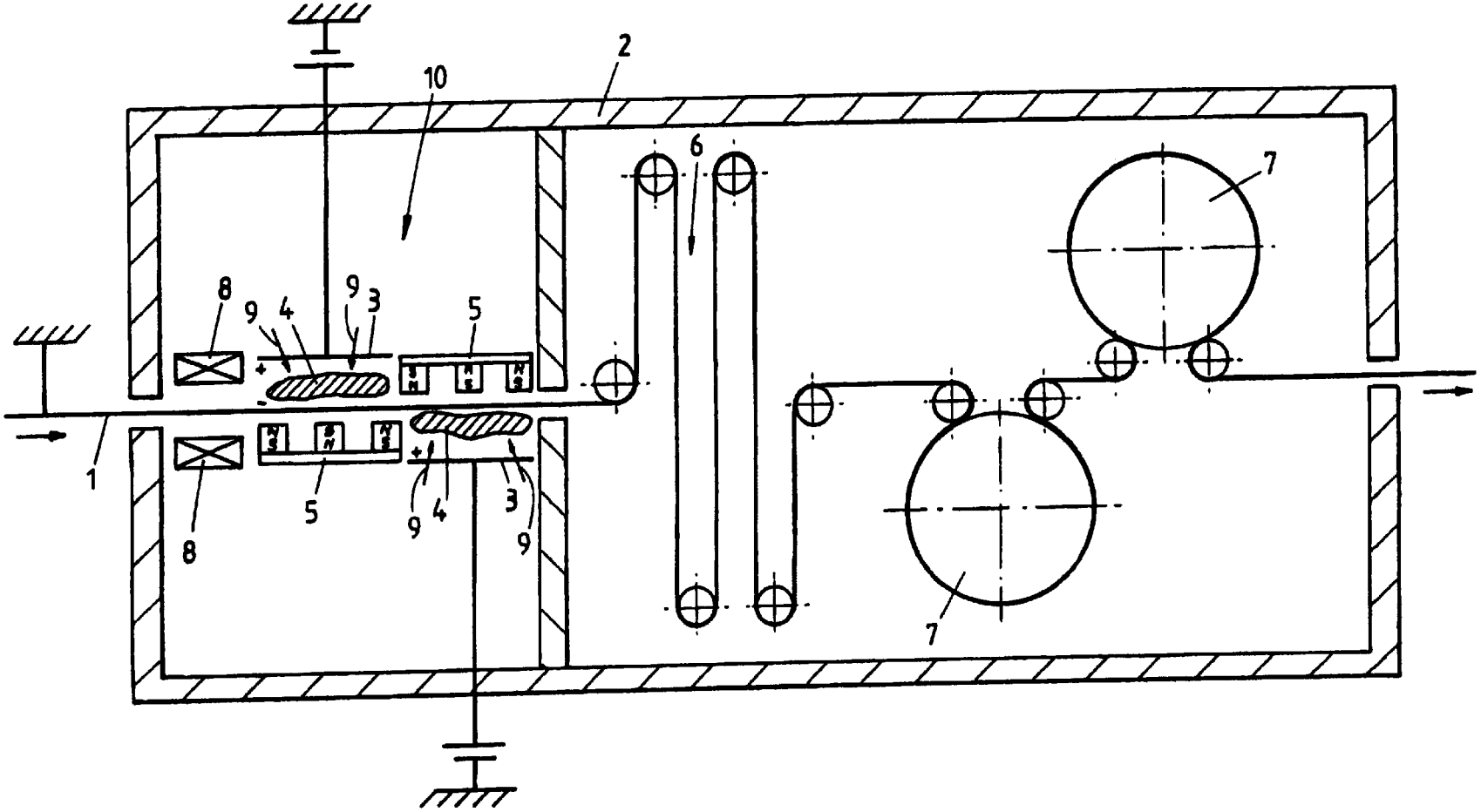
1
2
3
4
5
6
7
8
9
10

METHOD FOR MAKING A COMPOSITE METAL PRODUCT

CROSS REFERENCE TO RELATED APPLICATION

The present application is the national stage under 35 U.S.C. 371 of PCT/BE98/00154, filed Oct. 16, 1998.

The present invention relates to a process for the compositional setting of a metal product by the addition of at least one substance to this product.

In the current state of iron-and-steel technology, the compositional setting of a steel by means of one or more substances is generally carried out in a steelmaking ladle, a situation which has several drawbacks.

This is because the volumes treated are very large, thereby resulting in a certain lack of flexibility so far as some products require special heats. This is, for example, the case with phosphorus steels. These volumes also result in flux problems often associated with problems of downgrading the steels.

Moreover, the composition of a steel is always isotropic since the compositional setting is carried out in the liquid phase of the metal. It is therefore impossible to produce "composite" steels with a ductile core and a hard shell.

In addition, the crystallization and development of textures giving rise to optimum mechanical properties, such as a high yield stress, a high elongation and drawability, is often difficult in the presence of certain elements such as, for example, carbon and titanium, which could advantageously be introduced after the step of solidifying the metal.

The proposed process according to the invention provides a solution to these various problems.

By virtue of the process according to the invention, the compositional setting of the steels after the solidification step makes it possible to work with standard compositions of very large volume in steel making, something which makes it possible to dispense with special heats and, consequently, to greatly reduce the problems of downgrading. It is even possible to produce very small tonnages of special steels.

It furthermore makes it possible to produce "composite" steels having a compositional gradient between the surface and the core. It is thus possible, for example, to produce steels with a hard shell and a ductile core.

According to the invention, a process is proposed which allows the compositional setting of steels or of other metals after solidification. Thus, the crystallization of an ultralow-carbon steel followed by its compositional setting is possible. This manner of proceeding makes it possible to improve the mechanical properties compared with the case in which the crystallization is obtained with the final composition.

The process according to the invention is one wherein use is made of a metal product in the form of a continuous strip which is moved through a vacuum chamber, wherein the substance is applied to this strip and this substance is made to at least partially diffuse into the strip while it is passing through the vacuum chamber, by maintaining it at a temperature below its melting point but high enough to allow this diffusion.

Advantageously, the strip is preheated before the aforementioned substance is incorporated.

According to one particularly advantageous method of implementing the invention, the addition of the aforementioned substance into the strip is carried out by the technique of sputtering, by the technique of vacuum evaporation, by arc deposition, by decomposition of a carrier gas containing this substance in a plasma or by a combination of two or more of these techniques.

Further details and features of the invention will emerge from the description given below, by way of nonlimiting example, of a few particular embodiments of the invention with reference to the appended figure, which is a schematic representation of a plant for implementing the process according to the invention. In this description, the reference numbers relate to this figure.

In general, the invention relates to a process allowing the chemical composition of a metal to be modified in the solid state, according to which process use is made of a metal product in the form of a continuous strip which is moved continuously through a vacuum chamber, in which a total gas pressure of $10^{-4}$ to 100 torr, for example, obtains and in which a plasma is optionally created, opposite one or both of its faces, so as to introduce, for example by bombardment and/or diffusion, a predetermined substance, present in this chamber, into said strip. This strip is heated and maintained at a temperature high enough to allow at least partial diffusion of this substance into the strip. This temperature is, however, less than the melting point of the material of which the strip is composed. This may, for example, be a strip made of mild steel, stainless steel or aluminum. Thus, in the case of mild steel or stainless steel, the strip is preferably maintained at a temperature of about 600 to 1200° C., whereas in the case of aluminum this temperature is generally about 200 to 600° C.

According to the invention, it is in fact necessary to maintain conditions in the vacuum chamber which are such as to allow this substance to diffuse from the surf ace of the strip toward the core of the latter and thus to allow the composition of the strip to be set.

In order to allow this diffusion, the strip is advantageously preheated and the aforementioned substance is incorporated before or after an annealing step by means of discharges formed, for example, by a plasma.

The appended figure shows an annealing plant in which the compositional setting of a metal strip can be carried out according to the invention, this strip preferably consisting of a steel sheet moving approximately continuously through a vacuum chamber 2 of this plant in which the annealing is carried out by means of plasma discharges.

The discharges are established between the sheet 1, during its passage through a first zone 10 of this chamber 2, and a counterelectrode 3 in such a way as to dissipate the electrical power from the discharges in this sheet 1 and thus accomplish the annealing.

More specifically, this is, in fact, a process during which the sheet is bombarded by ions coming from a plasma 4, allowing rapid and uniform heating and, at the same time, descaling of the surface of the latter.

The plasma may be a DC plasma, the sheet then forming the cathode, or an AC plasma.

In the latter case, use is made of a counterelectrode 3 which extends, facing the sheet 1, in the vacuum chamber or annealing chamber 2 and has a surface, directed toward the sheet, whose area is greater than that of that part of the sheet which faces it, so as to maintain negative self-biasing of the latter.

As in the conventional process of magnetron sputtering, the discharge may optionally be carried out in the presence of magnetic induction fields by virtue of the presence of magnets 5 close to the sheet 1 and on the opposite side thereof with respect to the counterelectrode 3.

The power densities dissipated per face in the steel sheet 1 are typically between 1 $W/cm^2$ and 500 $W/cm^2$, while the run speeds of this sheet are generally between 1 m/minute and 1500 m/minute.

The temperature rise takes place in that region of the sheet where the power dissipation takes place, while the rate of temperature rise depends on the matching of the power density used, on the line speed as well as on the thickness of the sheet and on its heat capacity.

In some cases, it may be useful to introduce a temperature hold in the annealing cycle. This may, for example, be obtained by providing, in the vacuum chamber 2, a zone in which the sheet runs freely at a reduced pressure. In such a case, it is sufficient, for example, to provide a compartment 6, somewhat isolated from the zone 10 in which the heating takes place by the creation of the plasma. In this regard, it should be noted that, at reduced pressure, the heat losses caused by conduction into the gas are limited and the losses caused by radiation may be recovered in the sheet by means of reflectors or by radiant heating means (not shown).

In yet other cases, it may be useful to cool the sheet 1 in the vacuum chamber 2, and therefore at a reduced pressure, for example by making the sheet pass over cooling rolls 7.

According to the invention, the addition of the aforementioned substance may be carried out in the zone 10 by any vacuum deposition system indicated schematically by the reference 8, such as by sputtering using ions coming from a target (not shown) or by vacuum evaporation, by arc deposition or, more generally, by any PVD (physical vapor deposition) or PECVD (plasma-enhanced chemical vapor deposition) technique, that is to say by the decomposition of a carrier gas containing the substance in question, which is, for example, injected into the plasma, as shown schematically by the arrows 9 in the figure.

In another configuration of the invention, the substance may be injected into the temperature-hold zone 6 in which a discharge may optionally be created.

As already results from the foregoing, the process according to the invention comprises, in general, a temperature-rise step, obtained by the heat losses from the plasma 4 produced in the strip 1, and a temperature-hold step in the compartment 6 in which the strip 1 is arranged in a concertina fashion.

It has been found, according to the invention, that it is in this accumulation zone or compartment 6 that the diffusion of the substance takes place, forming the addition element or elements with the composition of the strip, which is fixed on the surface of the latter, from this surface toward the core or center of the strip. This therefore explains the possibility of forming a metal strip 1 with a hard shell and a ductile core.

However, it is also possible to obtain a metal strip in which the substance or the addition element is distributed homogeneously throughout its thickness. All that is required is to adapt the temperature and the hold time at this temperature in the compartment 6.

Moreover, it is also possible to coat the strip in the compartment 6 or in a subsequent special compartment, before the strip is cooled, by a finishing or protective film using techniques known per se.

Given below are two practical examples making it possible to illustrate further the process according to the invention, applied in a plant of the type shown in the appended figure.

EXAMPLE 1

Compositional Setting of a Substrate for Tinplate.

This involves more particularly the compositional setting in terms of carbon and of nitrogen of a steel sheet intended to be tinned. The base steel has the following composition: C:0.035%; N:0.0025%; Ti:0%; Mn:0.4%; B:0%; Al:0.04%

The steel continuously enters the plant at a line speed of 600 m/minute. The width of the strip is 1000 mm and its thickness is 0.2 mm. The inlet temperature of the heating zone 10 is 20° C. and the inlet temperature between the zone 10 and the hold zone 6 is 800° C. The temperature rise is achieved by a plasma over a sheet length of 7 m with a consumed power of 10 MW. A reactive mixture consisting of 90% nitrogen and 10% $C_2H_2$ is injected into the discharge. The decomposed gas is then entrained toward the temperature-hold zone 6. The total gas pressure is 0.02 torr. After this step, constituting in fact a reactive annealing step, the sheet is cooled and tinned. The mean final carbon and nitrogen composition of the sheet thus cooled is 0.06%.

EXAMPLE 2

Compositional Setting of a Boron Steel

Use is made of an ULCTi (Ultralow-Carbon Ti) steel sheet 1 mm in thickness, the composition of which is as follows:

C:0.003%; N:0.0025%; Ti:0.06%; Mn:0.15%; B:0%; Al:0.04%.

This strip continuously enters the plant at a line speed of 200 m/minute. The width of the strip is 1000 mm.

The heating takes place over a strip length of 10 m and the applied power is 10 MW, so as to reach 800° C. before the strip enters the compartment 6. Boron is deposited on the surface of the sheet prior to vacuum evaporation annealing in amount of 0.04 $g/m^2$ of boron per face.

The temperature-hold zone corresponds to a length of 200 m of the sheet.

The final boron composition of the sheet on leaving the plant is 0.001% and that of the other elements remains unchanged.

Of course, the invention is not limited to the embodiments described above, rather numerous alternatives embodiments may be envisaged without departing from the scope of the present invention, especially as regards the conditions under which the annealing and the diffusion of an addition substance intended for the compositional setting of the metal strip are carried out.

We claim:

1. A process for modifying the composition of a solid metal product by incorporating at least one modifying substance to said metal product, said process comprising moving said solid metal product in the form of a continuous strip through a vacuum chamber, said metal product having a first composition, applying said at least one modifying substance to at least one side of the strip, while the strip is moved through the vacuum chamber, said applying step comprising at least one plasma discharge, plasma annealing said strip in the vacuum chamber, at a strip temperature high enough to allow incorporation by diffusion of the at least one applied modifying substance into the solid metal product, but below the melting point of said solid metal product, and holding said strip temperature so as to obtain said diffusion from said at least one side of the strip up to the core thereof, while so producing a metal product having a second composition.

2. A process according to claim 1 wherein the plasma annealing comprises creating at least one annealing plasma discharge between at least one side of the metal strip and at least one counter-electrode and dissipating electrical power from the at least one annealing plasma discharge into the metal strip, with rapid and uniform heating of said metal strip.

3. A process according to claim 2, wherein said applying comprises injecting a gas containing or generating said at least one modifying substance into said at least one annealing plasma discharge.

4. A process according to claims 2, wherein said applying comprises injecting a gas containing or generating said at least one modifying substance into said at least one plasma discharge located close to at least one side of said metal strip, after the plasma annealing and during the holding.

5. A process according to claim 2, wherein said applying takes place before said plasma annealing.

6. A process according to claim 5, wherein the said applying is carried out by sputtering, by plasma-enhanced chemical vapor deposition, or by a combination thereof or with another vacuum deposition operation.

7. A process according to claim 2, wherein the strip is made of mild steel, stainless steel or aluminum.

8. A process according to claim 1, wherein said applying comprises injecting a gas containing or generating said at least one modifying substance into said at least one plasma discharge located close to at least one side of said metal strip, after the plasma annealing and during the holding.

9. A process according to claim 1, wherein the step of applying takes place before the step of plasma annealing.

10. A process according to claim 9, wherein said applying is carried out by sputtering, by plasma-enhanced chemical vapor deposition, or by a combination thereof or with another vacuum deposition operation.

11. A process according to claim 1, wherein the strip is made of mild steel, stainless steel or aluminum.

* * * * *